United States Patent [19]

Kamegaya et al.

[11] 4,162,427

[45] Jul. 24, 1979

[54] GAS-DISCHARGE DISPLAY PANEL

[75] Inventors: Takeo Kamegaya, Tokyo; Minori Yokozawa, Sagamihara; Ryuichi Kaneko, Kawasaki; Hideomi Matsuzaki, Hatano, all of Japan

[73] Assignee: Nippon Hoso Kyokai, Japan

[21] Appl. No.: 885,947

[22] Filed: Mar. 13, 1978

[30] Foreign Application Priority Data

Mar. 18, 1977 [JP] Japan ..... 52-29340
Jul. 7, 1977 [JP] Japan ..... 52-80381

[51] Int. Cl.[2] ..... H05B 37/00; H05B 39/00; H05B 41/00

[52] U.S. Cl. ..... 315/169.1; 340/704; 340/772

[58] Field of Search ..... 315/169 R, 169 TV; 340/324 M

[56] References Cited

U.S. PATENT DOCUMENTS 3,096,516 7/1963 Pendleton et al. ..... 315/169 TV 3,863,087 1/1975 Holz ..... 315/169 TV X

*Primary Examiner*—Alfred E. Smith
*Assistant Examiner*—Robert E. Wise
*Attorney, Agent, or Firm*—Stevens, Davis, Miller & Mosher

[57] ABSTRACT

A gas-discharge display panel comprises plural elongated minute gas-discharge cells arranged in matrix directly on inner faces of front and rear insulator plates, on opposite sides of which cells elongated anodes and cathodes are disposed respectively and which cells are driven by igniting pulses, sustaining pulse-trains and erasing pulses in response to picture signals to be displayed. In these cells glows appear closely by both of anodes and cathodes and excite fluorescent layers which are disposed on cell-walls at the closest distance, so that very high brightness and efficiency of gas-discharge display can be obtained with a simple structure, and further a memory function of gas-discharge can be effected by virtue of the sustaining pulse-trains.

13 Claims, 27 Drawing Figures

DC Voltage Driving

Pulsive Voltage Driving

GAS-DISCHARGE DISPLAY PANEL

BACKGROUND OF THE INVENTION (1) Field of the Invention

The present invention relates to a display panel realized by utilizing a gas-discharge, particularly, to a gas-discharge display panel provided for displaying a colored picture.

(2) Description of the Prior Art

Various researches and developments for displaying a colored picture on a gas-discharge display panel have been carried out vigorously hitherto. However many problems remain unsolved in those researches and developments. The most serious one of these problems is the low brightness and the low efficiency of the displayed colored picture.

In conventional gas-discharge display panels, gas-discharge cells which correspond respectively to picture elements to be displayed are arranged in matrix, and fluorescent layers which are disposed on cell-walls are excited by ultraviolet rays which are generated by the gas-discharge, and emit red (R), green (G) and blue (B) lights.

In case television pictures are displayed on these conventional gas-discharge display panels, gas-discharge cells which are arranged on respective rows of the matrix and correspond to picture elements on respective scanning lines, are driven in parallel, so as to brighten all of picture elements arranged on a line simultaneously in a predetermined time duration.

However, the brightness and the efficiency of colored pictures displayed on the conventional display panels in the above-mentioned manner are low insufficient because of the following defects.

In respect to the structure of the conventional display panels, (i) the amount of ultraviolet rays is insufficient for exciting fluorescent layers; (ii) the efficiency of observation of brightened fluorescent layers, which are observed from behind, too low; (iii) the spectrum of ultraviolet rays which are generated by the gas-discharge corresponds insufficiently to the excitation characteristics of fluorescent layers; (iv) gas-discharge cells are hardly ignited because of the high igniting voltage based on cold cathode operation.

In respect to the manner of driving the conventional display panels, (i) the length of time durations wherein respective elements are brighten is too short and insufficient; (ii) the electric power loss caused by load resistors and others consisting in the driving circuit is too large.

Furthermore, in respect to manufacturing the conventional display panels, the cost of production and assembly of various parts is high because of the complexity of structure.

SUMMARY OF THE INVENTION

An object of the present invention is to improve both the structure and the driving manner of the gas-discharge display panel, so as to solve all of the above-mentioned various problems.

Another object of the present invention is to realize the display of colored pictures with high brightness and high efficiency by means of driving gas-discharge cells provided with a new structure in a new manner which is based on a new concept.

Still another object of the present invention is to provide a gas-discharge display panel which is endowed with a memory function for facilitating a high brightness and high efficiency of displayed colored pictures.

As a result of wide investigations for solving the earlier-mentioned various problems, the present inventors found that the brightness and efficiency of displayed colored pictures can be greatly improved by virtue of a memory function for the display panel consisting of such gas-discharge cells as described later, wherein glows of gas discharge appeal close by both the anodes and cathodes by virtue of driving pulsive voltages.

A gas-discharge display panel according to the present invention is characterized as follows.

In the conventional gas-discharge cells, ultraviolet rays which appear only in either negative glows or positive columns of gas-discharges effected in those cells excite and brighten neighboring fluorescent layers. In contrast therewith, in gas-discharge cells according to the present invention, ultraviolet rays appear in both of the negative glows and anode glows of gas-discharges, because these glows are generated respectively close by elongated cathodes and elongated anodes which are arranged close by each other in parallel on opposite sides of cell-walls, and these glows are stimulated and sustained by virtue of driving pulsive voltages which are applied between those cathodes and anodes. A large amount of these ultraviolet rays excite and brighten fluorescent layers which are disposed close by those cathodes and anodes respectively, so that the high brightness and high efficiency of the gas-discharge display can be realized.

The aforesaid driving pulsive voltages according to the present invention consist of igniting pulses, erasing pulse-trains and sustaining pulses which maintain once arisen gas-discharges so as to endow the gas-discharge cells with a memory function, and further consist of auxiliary igniting pulses which are applied to auxiliary cathodes provided additionally for facilitating the ignition of gas-discharges for display with low igniting voltages.

Moreover, the structure of the gas-discharge display panel according to the present invention is simplified in such a manner as the aforesaid gas-discharge cells are arranged in matrix directly on inner faces of front transparent and rear opaque insulator plates.

In order that the above-mentioned invention may be readily carried into effect, preferred embodiments thereof will be described in detail, by way of example, with reference to the accompanying drawings.

DESCRIPTION OF THE PREFERRED EMBODIMENTS

Figure 1A:
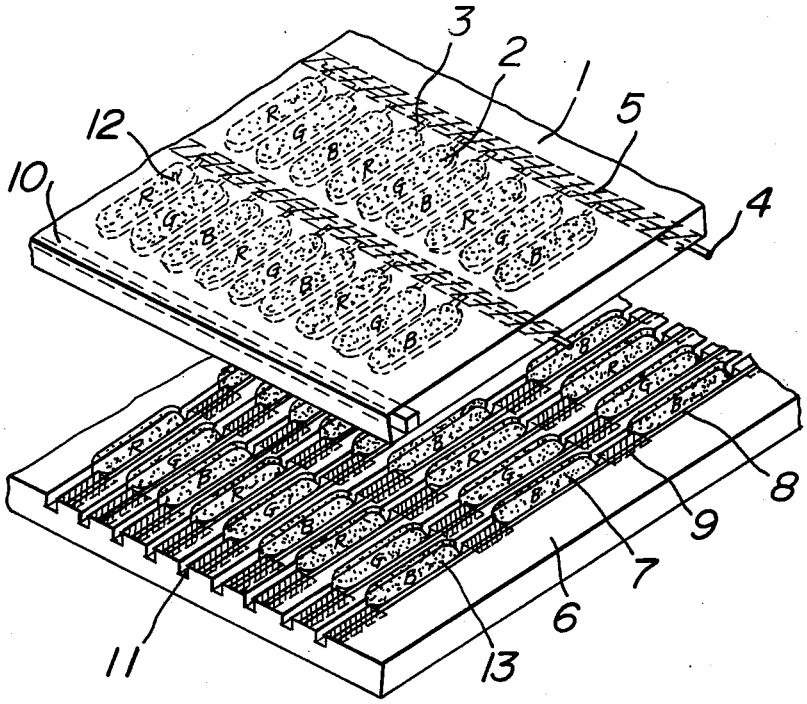
FIGS. 1(*a*), 1(*b*) and 1(*c*) are a separately perspective view, a cross-sectional view and a partially enlarged plan view respectively of a preferred embodiment of a gas-discharge display panel according to the present invention.
Figure 1B:
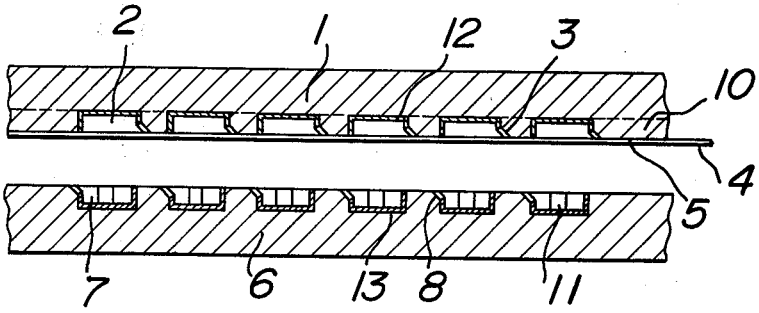
Figure 1C:
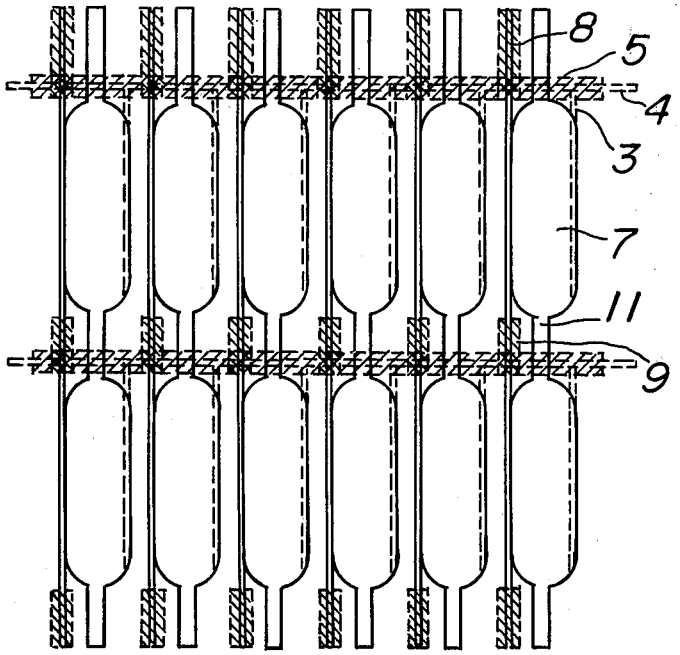

FIGS. 1(*a*), (*b*) and (*c*) show a preferred embodiment of a gas-discharge display panel according to the present invention.

In the configuration shown in FIGS. 1(*a*) to (*c*), 1 is a front transparent plate consisting of electrical insulation material, for instance, of glass, 2 is one of a plurality of elongated recesses arranged in matrix on an inner face of the front plate 1 in such a manner that the longitudinal directions thereof are parallel with each other, which recesses form gas-discharge cells in conjunction with discharge electrodes as described later, 3 is an anode consisting of an elongated conductor film or the like which is, disposed on one side of longitudinal edges of the elongated recess 2, 4 is an anode connecting conductor consisting of a lineal conductor film or the like which is, provided for connecting common ends of elongated anodes 3, 5 is an insulator film consisting of frit glass or the like which is provided for covering partially the anode 3 and the anode connecting conductor 4, 6 is a rear transparent or opaque insulator plate consisting of electric insulation material, for example, of glass, ceramic or the like, 7 is one of plural elongated recesses arranged in matrix on an inner face of the rear plate 6, which are confronted respectively with plural recesses 2 arranged on the inner face of the front plate 1, so as to form gas-discharging spaces consisting in aforesaid cells, 8 is a cathode consisting of an elongated conductor film or the like, which is disposed on the other side of longitudinal edges of the elongated recesses 7, 9 is an insulator film consisting of frit glass or the like, which is, provided for covering partially the cathode 8 disposed along longitudinal edges of the elongated recesses 7, 10 is a gas-piping slot which is arranged on the inner face of the front plate 1, 11 is a gas-piping slot which is arranged on the inner face of the rear plate 6, so as to connect the elongated recesses 7 successively in the longitudinal direction, and 12 and 13 are fluorescent layers of red (R), green (G) and blue (B), which are deposited inside the elongated recesses 2 and 7.

The gas-discharge display panel according to the present invention possesses a binary structure consisting of the above-mentioned front transparent and rear transparent or opaque insulator plates 1 and 6, fringes of which plates adhere to each other with frit glass or the like, so as to form a container having the function of a vacuum vessel filled with a single or mixed gas consisting of neon, argon, helium, krypton, xenon, nitrogen and mercury vapor.

The above-outlined embodiment of the gas-discharge display panel according to the present invention will be further described in structural and arrangement detail as follows.

In the embodiment shown in FIGS. 1(*a*) to (*c*), the elongated anode 3 consists of a conductor film which is deposited on a cut face formed along one side of longitudinal edges of the elongated recess 2 which is arranged on the inner face of the front plate 1 consisting of planar insulation material as shown in FIG. 1(*b*), and each one end of plural anodes 3 are connected in common to the anode connecting conductor 4, so as to form a comb-shaped group of discharge electrodes. Similarly, the elongated cathode 8 consists of a conductor film which is deposited on a cut face formed along the other opposite side of longitudinal edges of the elongated recess 7 which is arranged on the inner face of the rear plate 6 as shown in FIG. 1(*b*). Accordingly, plural anodes 3 and plural cathodes 8 are confronted respectively with each other in parallel at a minute distance which corresponds to the width of the recesses 2 and 7. Furthermore, plural gas-piping slots 11 are provided between longitudinal ends of the elongated recesses 7, which are arranged on the inner face of the rear plate 6, for connecting the gas-discharging spaces of plural cells with each other in the longitudinal direction, and one or more gas-piping slots 10 are provided in a fringe area of either side of the inner face of the front plate 1 in a direction crossing that of the slots 11. In case such colored pictures as television pictures are displayed on the display panel shown in FIG. 1, a picture element consists of a trio of gas-discharge cells wherein fluorescent layers of red (R), green (G) and blue (B) are deposited respectively.

The anode 3 of the aforesaid embodiment corresponds to a branch of the anode connecting conductor 4 which is disposed along a train of each one of longitudinal ends of plural elongated recesses 2 which are arranged in matrix on the inner face of the front plate 1, and the cathode 8 is a part of a lineal electrode conductor which is disposed along longitudinal sides of the elongated recesses 7 which are arranged on in matrix the inner face of the rear plate 6, and is confronted with the anode 3. Therefore, for the purpose of utilizing for picture display the gas-discharges which are generated between the anodes 3 and the cathodes 8 during the operation of the gas-discharge cells, both the negative glows which appear close by the cathodes 8 and the anode glows which appear close by the anodes 3 are available, and further a pair of these glows can be effected only by means of applying pulsive voltages between the anodes 3 and the cathodes 8 according to the present invention as described later.

As an alternative to the above-mentioned embodiment, it is possible to replace the anodes 3 and the cathode 8 with each other, that is, to arrange the cathode 8 on the inner face of the front plate 1 and to arrange the anode 3 on the inner face of the rear plate 6.

As discussed above, it is well-known to utilize ultraviolet rays which are generated by gas-discharges for exciting and brightening fluorescent layers, and various attempts have been made to effectively use this technique. However, all of those attempts are impractical because of insufficient brightness or other defects. These defects are mainly caused by the fact that the intensity of ultraviolet rays appearing in a plasma which is formed by the gas-discharge is insufficient because of an inappropriate construction of the gas-discharge cells, and that ultraviolet rays appearing in the plasma are absorbed by the filled gas before those rays reach the fluorescent layers because of too long a distance between the plasma and the fluorescent layers, and further that the amount of light radiated from the fluorescent layers is insufficient in general because of inadequate disposition and insufficient area of the fluorescent layers, which area is confronted directly with the plasma.

According to the present invention, as described above, the fluorescent layers 12 and 13 are deposited respectively inside the elongated recesses 2 and 7 consisting in the gas-discharge cells which are arranged on the inner faces of the front and rear plates 1 and 6, so that the plasma which is formed by the gas-discharge and the excitable fluorescent layers can be brought close by each other, and consequently the attenuation of ultraviolet rays, which is caused by the absorption of the filled gas can be reduced, and the plasma and those fluorescent layers can be confronted with each other by a sufficiently large area. Moreover, the extremely bright colored picture can be displayed by virtue of the aforesaid structure wherein the fluorescent layers can be observed in both manners of penetration and reflection.

On the other hand, by virtue of the aforesaid binary, i.e., two-component, structure according to the present invention, manufacturing and assembling of various parts consisting in the display panel can be simplified, and further the anodes 3 and the cathodes 8 which are arranged respectively on the inner faces of the front and rear plates 1 and 6 can be formed easily by means of depositing conduction materials on cut faces which are provided along the longitudinal edges of the elongated recesses 2 and 7, so that the anodes 3 and the cathodes 8 can be prevented from the contamination in manufacturing and from the error discharge which is caused between neighboring discharge electrodes in operation, and further a large number of gas-discharge cells can be arranged with an extremely high density, and consequently a gas-discharge display panel which facilitates the display of colored pictures having high quality can be realized easily.

The behavior of the gas-discharge display panel according to the present invention will now be described in detail.

The state of the gas-discharge generated in the gas-discharge cells of the display panel which is applied with DC driving voltages is observed in general as follows.

The face of the cathode is covered by the negative glow, which covers partially the face in the case where the discharge current is still comparatively small, and then covers the face entirely in response to the increase of the discharge current. In the state wherein the face of the cathode is covered entirely by the negative glow, the density of the discharge current is held at a constant value, and the discharge voltage presents a constant voltage characteristic. In the case where the applied source voltage is increased at this state, the density of the discharge current increases, whilst the cathode is covered entirely by the negative glow just as it is, so that the manner of the gas-discharge is shifted from the normal discharge to the abnormal discharge, which presents a positively polarized discharge voltage to discharge current characteristic.

Thereafter, in the case where the applied source voltage is further increased, the discharge voltage drops suddenly in response to the increase of the discharge current, and the manner of the gas-discharge is shifted from the abnormal discharge to the arc discharge, which ends in the breakdown of the gas-discharge cell.

With respect to the variation of the state of the gas-discharge according to the variation of the length of the gas-discharge cell, in the case where the gas-discharge cell is so short as the distance between the anode and the cathode is shorter than, for instance, 0.3 mm, only the negative glow appears in the cell, while, in case the aforesaid distance is beyond 0.3 mm, the Farady dark space appears as well as the negative glow. However, the light radiated from the Farady dark space is too dim to be observed from the outside. Further, in case the aforesaid distance is beyond 0.7 mm, the positive column appears as well as the negative glow and the Farady dark space. The length of the positive column increases according to the increase of the length of the cell, that is, the increases of the aforesaid distance, so that it can be recognized ultimately that brightening portions of the gas-discharge generated in the cells by the driving DC voltage, which portions can be utilized for displaying the picture, are the negative glow and the positive column.

The behavior of the gas-discharge cell consisting in the display panel according to the present invention will now be explained further in detail by referring to the above discussion.

Figure 2A:
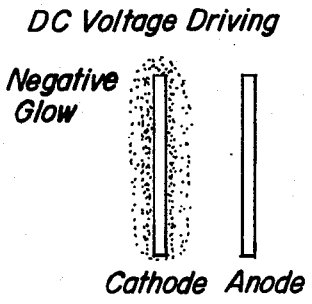
FIG. 2a PRIOR ART
FIGS. 2(*a*) and 2(*b*) are explanatory diagrams showing states of glow discharges appearing respectively in a conventional gas-discharge cell and in that of the present invention.
Figure 2B:
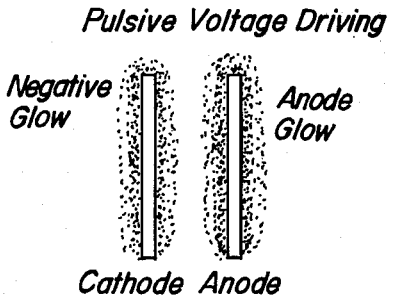

Before the explanation thereof, it should be noted that when a driving DC voltage is applied to the display panel shown in FIG. 1, the face of the cathode is covered by the negative glow as shown in FIG. 2(*a*), but the positive column cannot be observed as described above, and further, with response to the increase of the applied source voltage, the density of the discharge current increases as mentioned above, but the state of the brightening portion of the gas-discharge remains the same.

On the other hand, in case the same display panel is applied with the driving pulsive voltage, which generates the pulsive gas-discharge, the anode glow appears close by the anode and the negative glow appears close by the cathode as shown in FIG. 2(*b*).

The aforesaid anode glow is a phenomenon which is peculiar to the pulsive gas-discharge, which phenomenon was discovered by the present inventors, and can be explained as follows.

Figure 3A:
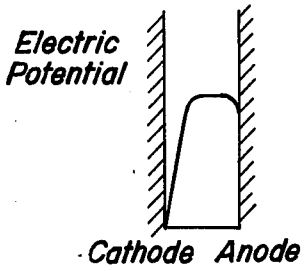
FIG. 3a PRIOR ART
FIGS. 3(*a*) and 3(*b*) are explanatory diagrams showing states of electric potential distributions between a cathode and an anode appearing respectively in a conventional gas-discharge cell and in that of the present invention.
Figure 3B:
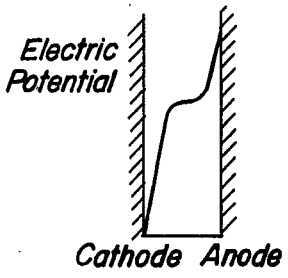

FIG. 3(*a*) shows schematically the electric potential distribution between the anode and the cathode of the aforesaid gas-discharge cell which is applied with the driving DC voltage, and FIG. 3(*b*) shows schematically that of the same gas-discharge cell which is applied with the driving pulsive voltage. With respect to the case of the DC discharge shown in FIG. 3(*a*), a strong electric field is formed in front of the cathode owing to the cathode fall, and contributes to the emission of electrons from the cathode. In respect to the distribution of charged particles in the gas-discharge space, positive ions appear in front of the cathode, and the so-called plasma consisting of a mixture of positive ions and electrons is formed in a medium region beyond the cathode fall. The electric potential distribution in the region of the plasma is shifted flatly as shown in FIG. 3(*a*), and then is jointed to the anode fall in front of the anode. In case the distance between the cathode and the anode is comparatively short similarly as that according to the present invention, the positive column does not appear as shown in FIG. 2(*a*). Besides, in respect to the electric potential distribution in the region of the anode fall, electrons and positive ions consisting in a group of charged particles which appear in that region are distributed in balance with each other, because electrons impinge continuously and smoothly on the anode, so that the anode fall causes only a weak electric field in front of the anode.

On the other hand, with respect to the case of the pulsive discharge shown in FIG. 3(*b*), a strong electric field is formed in front of the cathode similarly as in the case of the DC discharge shown in FIG. 3(*a*). However, the electric potential distribution in the region of the anode fall in front of the anode is quite different from that in the case of the DC discharge. That is, in the case of the pulsive discharge, since the pulsive discharge current impinges on the anode, the unbalance which is caused in the charged particles, namely, the positive ions and the electrons, which particles consist in the plasma in front of the anode induces the redistribution of the charged particles, whereby a positive anode fall is formed by the positive ions in front of the anode. When the positive fall exceeds the excitation voltage or the ionization voltage, the excitation of atoms and the ionization are promoted, so that the radiation of ultraviolet rays and visible rays according to the energy transfer forms the aforesaid anode glow.

By the way, the state of the formation of the anode glow is varied according to the curvature and the condition of the anode face, and further according to the composition and the pressure of the filled gas, so that it is hardly defined in generally speaking. Nevertheless, according to an experiment wherein a gas mixture consisting of helium as a main and 10 to 20% of xenon is filled in the gas-discharge cell with the pressure of 150 to 200 mmHg, the pulsive driving voltage which is required for the formation of a distinct anode glow presents a build-up time which is shorter than 2 to 3 $\mu$s and a pulse width which is shorter than 15 $\mu$s, and a peak value of the discharge current density exceeds 0.5 A/cm$^2$.

As a method for driving the gas-discharge display panel shown in FIGS. 1(*a*) to (*c*), such a pulsive voltage driving as described above can be used, the fundamental behavior thereof being as follows.

Figure 4:
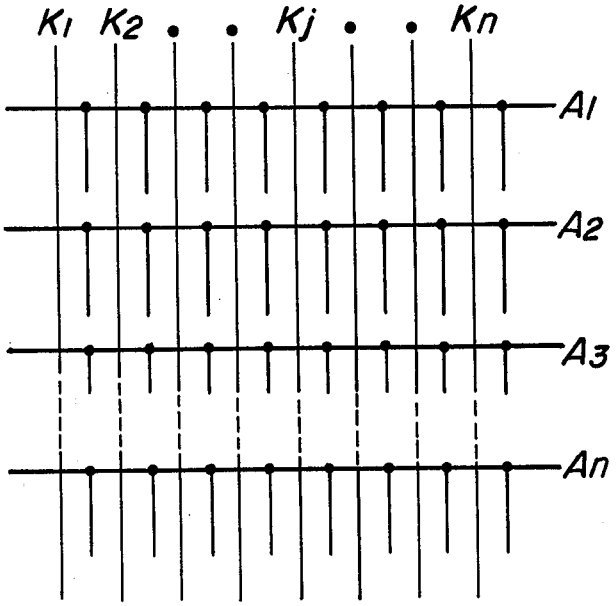
FIG. 4 is a schematic diagram showing an example of the arrangement of discharge electrodes provided in a gas-discharge display panel according to the present invention.
Figure 5A:
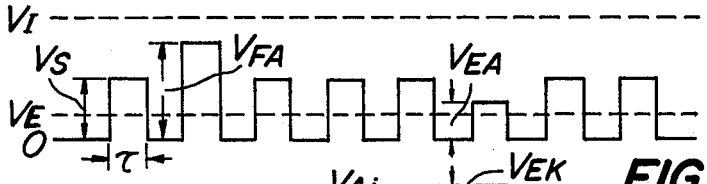
FIGS. 5(*a*), 5(*b*) and 5(*c*) are schematic diagrams showing respectively various waveforms of driving pulsive voltages and of pulsive radiations relating to various electrodes consisting in a gas-discharge display panel of the present invention.
Figure 5B:
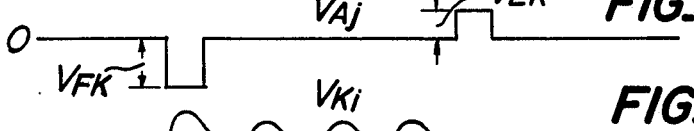
Figure 5C:
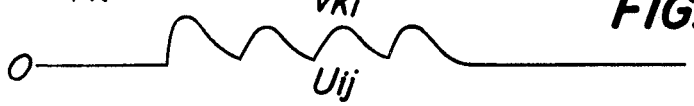

FIGS. 4 and 5 show respectively the arrangement of electrodes which are provided in the gas-discharge cells and waveforms of driving pulsive voltages which are applied thereto, so as to explain the principle of the behavior of the aforesaid pulsive voltage driving. In FIG. 4, $A_1, A_2, \ldots, A_n$ are anodes, and $K_1, K_2, \ldots, K_n$ are cathodes.

In FIG. 5, $V_I$ is an igniting voltage of the gas-discharge cells, and $V_E$ is an erasing voltage of those cells.

At first, in order to drive the aforesaid gas-discharge display panel, a sustaining pulse train is always applied to the anodes against the potential of the cathode, which pulse train consists of pulsive voltages $V_S$ which appear repeatedly at an appropriate interval as shown in FIG. 5. The amplitude $V_S$ of those pulsive voltages is defined as $V_E<V_S<V_I$. However, since the erasing voltage $V_E$ and the igniting voltage $V_I$ are varied according to the composition and the pressure of the filled gas, the sustaining pulsive voltage $V_S$ is varied also. With regard to the trend of variation of the sustaining pulsive voltage the well-known Passion's law can be applied. Furthermore, it is required to settle the pulse width $\tau$ of the sustaining pulsive voltage $V_S$ into a time duration corresponding to the time length which elapses from an ignition to a steady state of the gas-discharge of the cell, that is, until the ignited gas-discharge is settled into the state of normal discharge, which time length is varied according to the composition and the pressure of the filled gas and further to the amplitude of the pulsive voltage. Moreover, it is required to settle the interval of repetition of the pulse train $V_S$ into a time length which is not longer than that which elapses until the charged particles disappear in the discharge space of the cell after the erasure of the gas-discharge, that is, the so-called ion extinction time.

Now, the behavior of writing, that is, igniting and eliminating, that is, erasing for a gas-discharge cell $U_{ij}$, which is disposed on a cross-point between the i-th column and the j-th row of the matrix wherein the plural cells are arranged, will be described as follows.

At first, in case the gas-discharge cell $U_{ij}$ will be ignited, the anodes $A_j$ which are disposed on the j-th row are applied with a pulsive voltage which has such an appropriate time duration as shown in FIG. 5(*a*) and an amplitude $V_{FA}$ which is defined as $V_S<V_{FA}<V_I$, as well as the cathodes $K_i$ which are disposed on the i-th column are applied with a pulsive voltage which has the same time duration and the opposite polarity in comparison with the aforesaid pulsive voltage $V_{FA}$ and further an amplitude $V_{FK}$, at the same instant as shown in FIG. 5(*b*), so that the voltage applied between the anode $A_j$ and the cathode $K_i$ is settled into a value of $V_{FA}+V_{FK}$, which has a relation of $V_I<V_{FA}+V_{FK}$ against the igniting voltage $V_I$, so that the gas-discharge cell $U_{ij}$ is ignited. After the gas-discharge is once generated, a state of plasma is held in the gas-discharge space of the cell $U_{ij}$, and then the multiplication of the plasma is stopped after the aforesaid time duration of the applied pulsive voltages $V_{FA}$, $V_{FK}$ has elapsed. However, those pulsive voltages $V_{FA}$, $V_{FK}$ coincide with one of the pulsive voltages $V_S$ consisting in the sustaining pulse train which is always applied to all of the anodes, and the repetition interval of these pulsive voltages $V_S$ is comparatively short, so that the gas-discharge space of the cell $U_{ij}$ is held in a state of after-glow until a succeeding pulsive voltage $V_S$ is applied to the cell $U_{ij}$ after the pulsive voltages $V_{FA}$, $V_{FK}$ disappear. Accordingly, in case the gas-discharge is once generated, the amplitude of the sustaining pulsive voltages $V_S$ having the aforesaid comparatively short repetition interval is not required to be equal to those of the igniting pulsive voltages $V_{FA}$ and $V_{FK}$, but to be enough to sustain the gas-discharge which is once generated. By means of applying such sustaining pulsive voltages, the gas-discharge is generated repeatedly as shown in FIG. 5(*c*), so that a memory function of sustaining the gas-discharge which is once ignited is endowed to the gas-discharge cell, so that the display panel having the extremely high brightness can be realized.

In the next place, in case the gas-discharge will be erased, a pulsive voltage $V_{EA}$ which has an amplitude being smaller than that of the sustaining pulsive voltage $V_S$ and being larger than the erasing voltage $V_E$ is applied to the anodes $A_j$ which are disposed on the j-th row within the aforesaid time duration which is required for sustaining the gas-discharge which is once ignited, as well as a pulsive voltage $V_{EK}$ which has the synchronism and the same polarity with regard to the aforesaid pulsive voltage $V_{EA}$ is applied to the cathodes $K_i$ which are disposed on the i-th column, so that the voltage which is applied between the anode $A_j$ and the cathode $K_i$ is settled into a value of $V_{EA}-V_{EK}$, which value has a relation of $V_E>V_{EA}-V_{EK}$ as against the erasing voltage $V_E$, so that the gas-discharge which has been generated in the cell $U_{ij}$ can be erased.

By the way, in the above-mentioned case of the ignition, the gas-discharge cells other than the cell $U_{ij}$, which have respectively a discharge electrode connected to the anode $A_j$ or to the cathode $K_i$, are applied respectively with the pulsive voltage $V_{FA}$ or $V_S+V_{FK}$, an amplitude of which is comparative with that of the sustaining pulsive voltage $V_S$. However, the pulsive voltage $V_{FA}$ or $V_S+V_{FK}$ is lower than the igniting voltage $V_I$, so that, in the aforesaid other gas-discharge cells, the gas-discharge is never ignited by those pulsive voltages $V_{FA}$ or $V_S+V_{FK}$.

On the other hand, in the above-mentioned case of the erasure, the aforesaid other gas-discharge cells are applied with the pulsive voltage $V_{EA}$ or $V_S+V_{EK}$ having a level which is lower than that of the sustaining pulsive voltage $V_S$, but is higher than the erasing voltage $V_E$, so that the gas-discharges which have been ignited already in those other cells is never erased.

In case characters or pictures are displayed on the gas-discharge display panel which is shown in FIGS. 1(*a*) to (*c*), writing, that is, igniting and eliminating, that is, erasing are performed as occasion demands, by means of applying the aforesaid various pulsive voltages selectively between the anodes and the cathodes consisting respectively in the gas-discharge cells which correspond to those characters and the pictures to be displayed. With regard to the method of driving the aforesaid gas-discharge cells for displaying the pictures, for example, one field interval of 16.7 ms is divided into minute displaying intervals having respectively individual time durations which are successively in proportion to the ratio of 1, 2, 4 and so on, and which correspond respectively to each of successive bits consisting in a PCM signal which is obtained by digitizing a video signal in a process of analog to digital conversion, and the ignitions of respective gas-discharges which correspond to the aforesaid minute displaying intervals are controlled by bit informations which represents that either writing should be performed or not at the respective starting points of those minute displaying intervals, so that the gas-discharge display representing the medium graduation of the pictures can be effected.

Figure 6A:
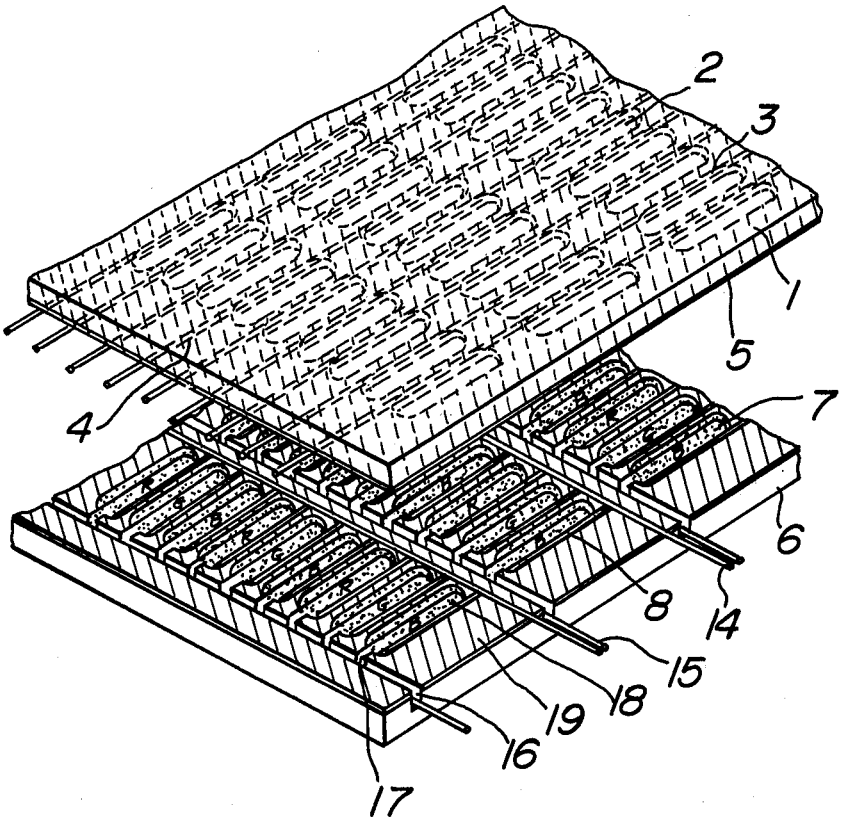
FIGS. 6(*a*), 6(*b*) and 6(*c*) are a separately perspective view, a cross-sectional view and a partially enlarged plan view respectively of another preferred embodiment of a gas-discharge display panel according to the present invention.
Figure 6B:
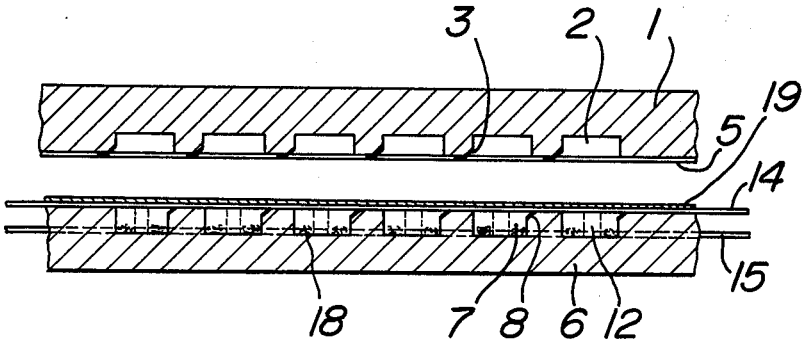
Figure 6C:
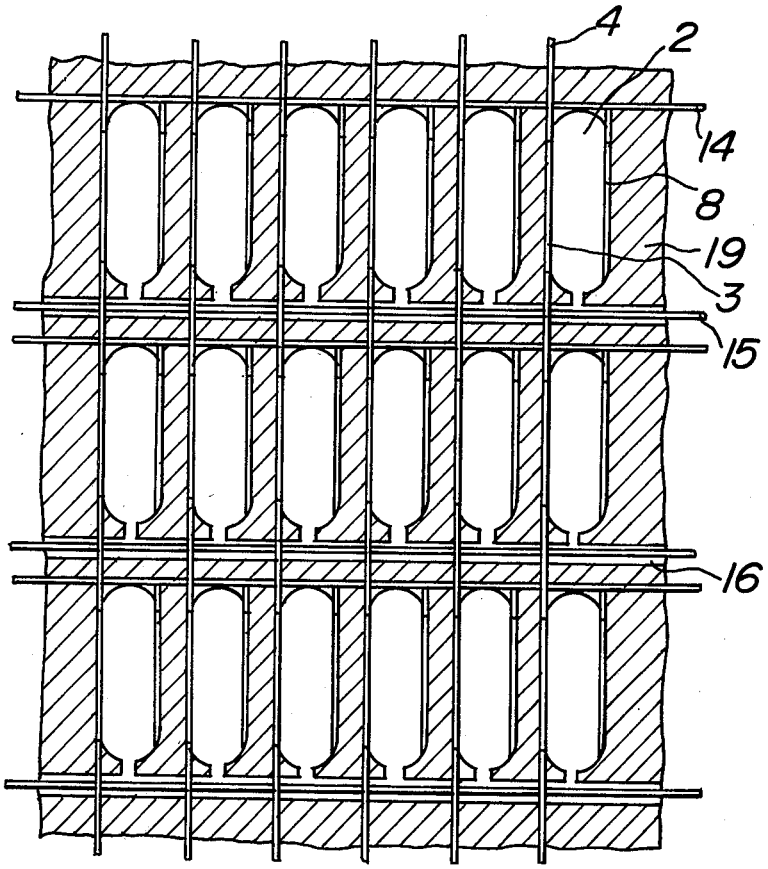

FIGS. 6(*a*), (*b*) and (*c*) are respectively a separately perspective view, a cross-sectional view and a partially enlarged plan view of further another preferred embodiment of a gas-discharge display panel according to the present invention.

In the embodiment shown in FIGS. 6(*a*) to (*c*), the portions which are given with the same reference numbers as those shown in FIG. 1(*a*) to (*c*) are formed almost the same as the portions corresponding thereto in FIGS. 1(*a*) to (*c*), and further the following additional portions are included.

Numeral 14 denotes a cathode connecting conductor which consists of conductor film or the like provided for connecting each one end of the cathodes 8 with each other in a transversal direction, 15 is an auxiliary cathode lineal conductor, that is, so-called keep alive cathode, which is accommodated in a slot 16 arranged in parallel with the cathode connecting conductor 14 so as to accelerate and stabilize the ignition of the gas-discharge cell, 17 is a slot which is provided for coupling the slots 7 and 16 with each other so as to form a path of so-called keep alive discharge which is generated between the keep alive cathode 15 and either the anode 3 or the cathode 8, 18 are fluorescent layers of red (R), green (G) and blue (B), disposed which are on the bottoms of the recesses respectively, and 19 is an insulator film which of frit glass and alike provided for covering the cathode connecting conductor 14. The embodiment shown in FIGS. 6(*a*) to (*c*) will be further described in detail.

The elongated anode 3 is formed by means of depositing a conductor film on a cut face which is formed on one side edge of an elongated recess 2 in the longitudinal direction thereof, which recess is arranged on the inner face of the front plate 1 which consists of transparent insulation material, as shown in FIG. 6(*b*). On the other hand, the elongated cathode 8 is formed by means of depositing a conductor film on a cut face which is formed on the other side edge of an elongated recess 7 in the longitudinal direction thereof, which recess is arranged on the inner face of the rear plate 6 which consists of transparent or opaque insulation material, as shown in FIG. 6(*b*). Accordingly, the anode 3 and the cathode 8 are closely opposite to each other at a distance which corresponds to the minute width of the recesses 2, 7.

Each one end of the cathode 8 is connected to the cathode connecting conductor 14 so as to form a comb-shaped group of discharge electrodes. The auxiliary cathode lineal conductor, namely, the keep alive cathode 15 is accommodated in the slot 16, provided between the rows of recesses 7 existing in the gas-discharge cells arranged on the inner face of the rear plate 6. Each slot 16 is elongated in the transversal direction against those recesses 7, and is coupled in common to those gas-discharge cells in a row through the coupling slots 17, so as to excite those gas-discharge cells thereby, and consequently, as described later, both of the negative glow generated close by the cathode 8 and the anode glow generated close by the anode 3 are utilized for displaying the picture. The slot 16 accommodating the keep alive cathode 15 runs along side each group of three gas-discharge cells inside which the fluorescent layers of red (R), green (G) and blue (B) are deposited respectively corresponding to picture elements when a color picture display device is used.

In the next place, the method of driving the gas-discharge display panel which is shown in FIGS. 6(*a*) to (*c*) with the pulsive driving voltages will be described in detail by referring to FIGS. 7(*a*), (*b*) and (*c*) which show respectively the basic operation thereof.

Figure 7A:
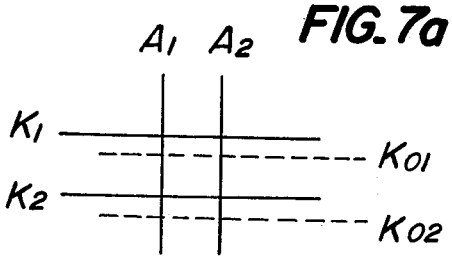
FIGS. 7(*a*), 7(*b*) and 7(*c*) are explanatory diagrams showing respectively a partial arrangement of discharge electrodes consisting in the embodiment shown in FIGS. 6(*a*), 6(*b*) and 6(*c*), time sequences of operation modes thereof and various waveforms of driving pulsive voltages applied thereto.
Figure 7B:
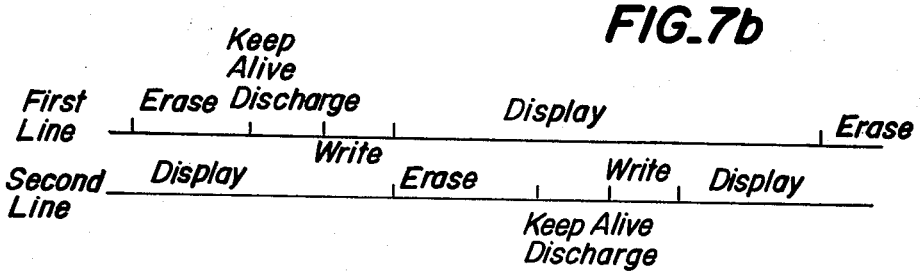
Figure 7C:
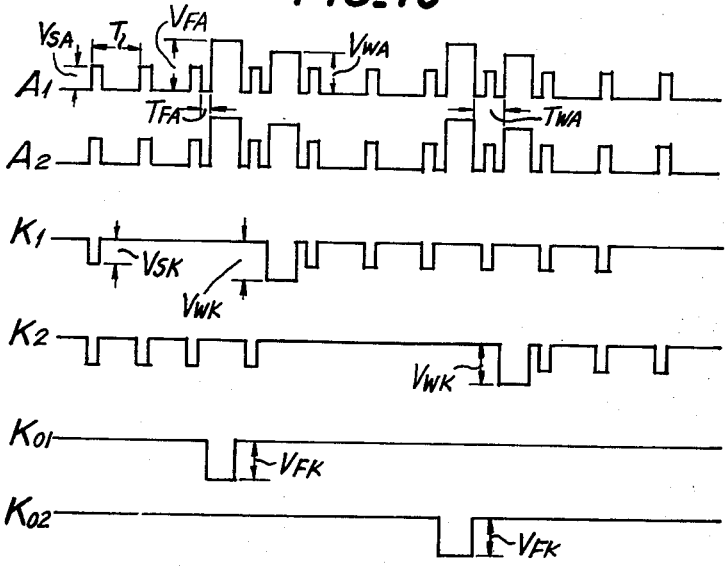

FIG. 7(*a*) shows schematically the discharge electrodes which belong only to two rows and two columns of the matrix wherein all of gas-discharge cells are arranged. $K_1$ and $K_2$ are each groups of the cathodes 3 which are arranged respectively on the first and second lines of the raster whereon the picture is displayed. FIG. 7(*b*) shows the time sequence of operation modes which are effected on each of those lines, and FIG. 7(*c*9 shows examples of waveforms of the pulsive driving voltages which are used for effecting those operational modes.

As shown in FIG. 7(*b*), the operation modes of the gas-discharge cell consist of four kinds of modes, igniting (writing), erasing (eliminating), displaying and keeping alive. In the gas-discharge display panel which is endowed with the memory function based on the aforesaid pulsive voltage driving according to the present invention, during a period where an operation of display is effected on one line of the raster, other operations of display and others can be effected on other lines at the same time, in such a manner as distinctively different from that in conventional gas-discharge display panels which are endowed with no memory function.

With regard to the first line shown in FIG. 7(*b*), all of gas-discharge cells which belong to the first line are once erased before a certain displaying period is commenced, and then a keep alive discharge is newly generated, so as to ignite the gas-discharge cells by virtue of the excitation which is caused by the keep/alive discharge according to the data of informations to be displayed.

For example, those data consist of "0" and "1" which represent the information to be displayed. Where the datum is "0", the gas-discharge cell corresponding thereto is left in a state of erasure, and contrarily, where the datum is "1", the gas-discharge cell corresponding thereto is once ignited, and in the displaying period succeeding to the ignition, the gas-discharge which is once ignited in the cell wherein the writing of the datum "1" has been carried out is sustained by means of applying the sustaining pulsive voltages repeatedly so as to maintain the state of gas-discharge by virtue of the above-mentioned memory function throughout the aforesaid displaying period, while, in other cells wherein the writing of the datum "1" is not carried out, the gas-discharging is not at all generated regardless of applying the sustaining pulsive voltages repeatedly.

The above-mentioned operations of gas-discharge cells are repeated throughout the whole time duration wherein the informations should be displayed. With regard to the second line shown in FIG. 7(*b*), similar operations of the gas-discharge cells, which are accompanied only with a certain amount of shift of timing against those on the first line, are performed and further, with regard to the third line, the fourth line and so on, similar operations which are accompanied with successive shift of timing are performed, so that the picture can be displayed on the whole display panel.

The above-mentioned operations of the gas-discharge display panel according to the present invention will be described further in detail by referring to the waveforms of the driving pulsive voltages which are shown in FIG. 7(*c*).

Among the waveforms which are shown in FIG. 7(*c*), the pulse train which is applied to the anodes $A_1$ and $A_2$ with an interval T of repetition consists of a train of sustaining pulsive voltages which are provided for maintaining the gas-discharge during the displaying period, the amplitude of which pulsive voltages is settled into the amount $V_{SA}$. On the other hand, the pulse train which consists of negative pulsive voltages having the amplitude $-V_{SK}$ is applied to the cathodes $K_1$ and $K_2$ at timings which correspond respectively to those of the aforesaid sustaining pulsive voltages in respective displaying periods. So that the total amplitude of pulsive voltages which are applied between the anodes $A_1$, $A_2$ and the cathodes $K_1$, $K_2$ corresponds to the amount of $V_{SA}-V_{SK}$, which amount is required in order to satisfy the following condition which is imposed so as to endow the aforesaid memory function to the gas-discharge cell.

$$V_{I1}(T)<V_{SA}-V_{SK}<V_{I0}(T)\ldots \quad (1)$$

where, $V_{I0}(T)$ represents an igniting voltage which is applied in the case where no gas-discharge has appeared in each cell at least in the preceding interval T, and $V_{I1}(T)$ represents that which is applied in the case where gas-discharge has appeared in the preceding interval T.

When the sustaining pulsive voltages which satisfy the above condition (1) are applied, pulsive gas-discharges are generated repeatedly almost in a continuous state in the cells wherein the gas-discharge has once appeared according to the writing of the datum "1", while the gas-discharge does not appear at all in the cells wherein the writing of the datum "1" is not carried out, so that the brightening gas-discharge which is maintained by virtue of the aforesaid memory function can be obtained according to the writing of the datum "1".

In the next place, the erasure of the gas-discharge which should be effected after the displaying period is over, is effected by means of stopping the application of the aforesaid sustaining pulsive voltages $V_{SK}$ to the cathodes K. A period wherein the negative pulsive voltages which have the amplitude $V_{SK}$ are not applied to the cathode $K_1$, $K_2$ as shown in FIG. 7(*c*), corresponds to that of the erasure of the gas-discharge. In this period, the total voltage which is applied between the anode and the cathode comes only to the amount $V_{SA}$. Accordingly, with respect to the erasure of the gas-discharge, the following condition is required.

$$V_{SA}<V_I(T)\ldots \quad (2)$$

The time length of the erasing period is settled into a length of 2T in comparison with the interval T of the sustaining pulsive voltages, and the amplitude of the sustaining pulsive voltages $V_{SA}$ which is applied to the anodes is required to be settled into an amount which does not ignite the gas-discharge at all in the erasing period.

In the keeping alive period which follows the erasing period, the keep alive discharge is generated between the anodes $A_1$, $A_2$ and the keep alive cathodes $K_{01}$, $K_{02}$. In this case, even if the keeping alive period is allocated, for instance, to the first line, the displaying period can be allocated to the other second line at the same time, so that the anodes $A_1$, $A_2$ are applied with the sustaining pulsive voltages $V_{SA}$ successively. Accordingly, the keep alive discharge is required to be generated in the intermediate duration between the sustaining pulsive voltages.

As shown in FIG. 7(*c*), in order to ignite the keep alive discharge, it is required that the anodes $A_1$, $A_2$ are applied with the positive pulsive volgage $V_{FA}$, and the keep alive cathodes $K_{01}$, $K_{02}$ are applied with the negative pulsive voltage $-V_{FK}$ on the following condition.

$$V_{OI} < V_{FA} - V_{FK} \quad (3)$$

where, $V_{OI}$ represents the auxiliary igniting voltage, that is, the so-called keeping alive voltage, which is to be applied to those keep alive cathodes $K_{O1}$, $K_{O2}$ in case no gas-discharge has appeared in neighboring gas-discharge spaces.

As mentioned above, the keeping alive period is settled during the interval T of the sustaining pulsive voltages as shown in FIG. 7(*c*), and further, similarly as in the erasing period, plural pulsive voltages which have an uniform amplitude commonly can be applied to the keep alive cathodes repeatedly throughout the keeping alive period, the time duration thereof being settled into a time length which corresponds to the interval T of the sustaining pulsive voltages. In such an elongated keeping alive period, the aforesaid keeping alive voltage $V_{OI}$ can be lowered, and further the pulsive voltages $V_{FA}$ and $V_{FK}$ which are applied respectively to the anode and the keep alive cathode for generating the keep alive discharge can be reduced in amplitude also. Moreover, since these driving pulsive voltages $V_{FA}$, $V_{FK}$ are those which have the largest amplitude which is used in the gas-discharge display panel according to the present invention, it is required that these driving pulsive voltages $V_{FA}$, $V_{FK}$ do not generate at all erroneous discharges in other discharge spaces except that wherein the keep alive discharge should be generated, and besides, with regard to the erroneous discharges which would be generated between the anode and the cathode, the following condition is satisfied.

$$V_{FA} < V_{I1}(T_{FA}) \quad (4)$$

where, $T_{FA}$ represents a time duration which elapses until the keeping alive pulsive voltage is applied after a gas-discharge sustained by the sustaining pulsive voltages has disappeared, and $V_{I1}(T_{FA})$ represents an igniting voltage which is required in case the aforesaid time duration has expired, and besides the following condition is satisfied.

$$V_{I1}(T_{FA}) < V_{I1}(T)$$

In the writing period, the writing-pulsive voltages $V_{WK}$ and $V_{WA}$ are applied respectively to the cathode and the anode, as well as the sustaining pulsive voltages $V_{SK}$ and $V_{SA}$ are applied respectively to the cathode and the anode. In order that the writing is performed, it is required that the following condition is satisfied.

$$V_{I1}(T_{WA}) < V_{WA} - V_{WK} \quad (5)$$

where, $T_{WA}$ represents a time duration which elapses until the writing pulsive voltage is applied after the keep alive discharge has disappeared, and $V_{I1}(T_{WA})$ represents an igniting voltage which is required in case the aforesaid time duration $T_{WA}$ has expired. Moreover, the writing pulsive voltage $V_{WA}$ is required to be settled into an amount whereby a gas-discharge is not generated at all between the anode which is applied therewith and other undesired cathodes.

By using the above-mentioned method of driving the gas-discharge display panel, the gas-discharge which is generated in the displaying period can be initiated without regard to whether the keep alive discharge has been generated in the writing period. Further, by means of repeating all of the above-mentioned various operation modes, for instance, at the field interval of the television signal, throughout the whole displaying time duration, the length of which is settled as mentioned earlier, a television picture can be displayed on the gas-discharge display panel according to the present invention.

Figure 8A:
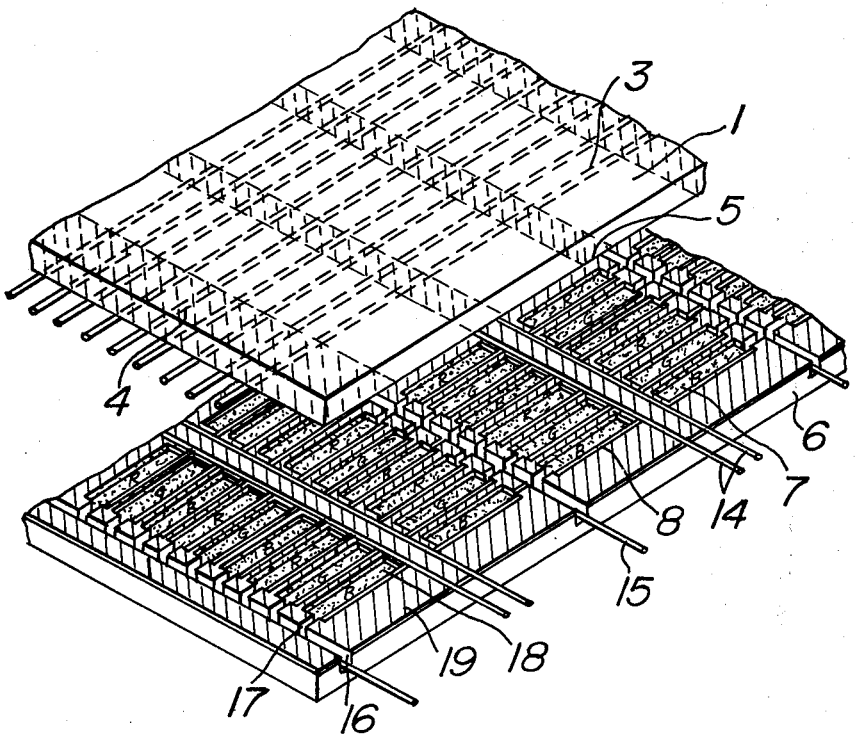
FIGS. 8(*a*), 8(*b*) and 8(*c*) are a separately perspective view, a cross-sectional view and a partially enlarged plan view respectively of further another preferred embodiment of a gas-discharge display panel according to the present invention.
Figure 8B:
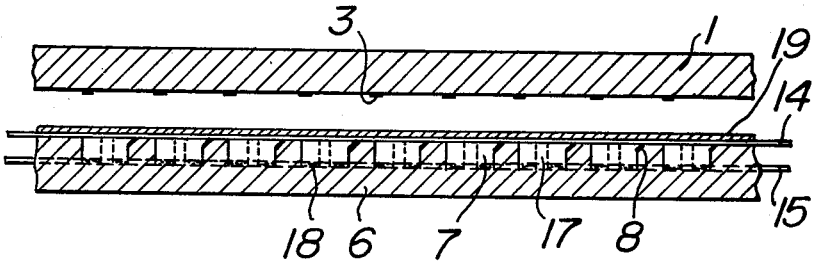
Figure 8C:
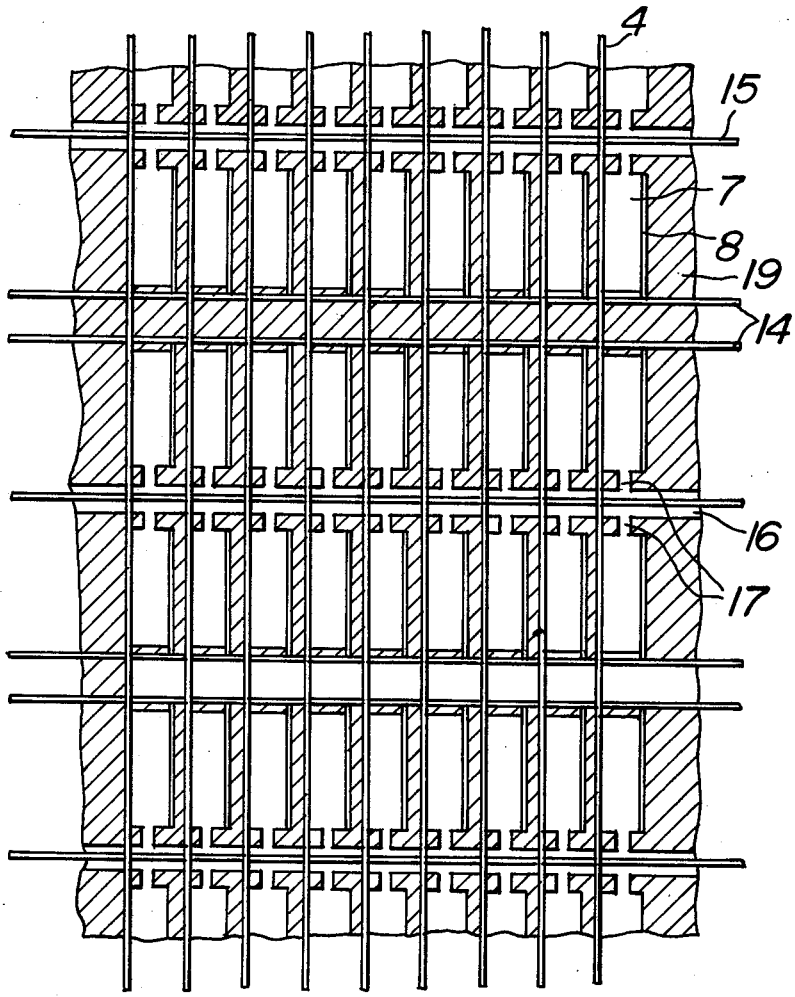

FIGS. 8(*a*), (*b*) and (*c*) are respectively a separately perspective view, a cross-sectional view and a partially enlarged plan view, which show another preferred embodiment of the gas-discharge display panel according to the present invention.

In the embodiment shown in FIGS. 8(*a*) to (*c*), each of the keep alive cathodes 15 is arranged so as to excite commonly both of the keep alive discharges which are generated respectively in two gas-discharge cells, and further the elongated recesses 2, which are formed on the inner face of the front plate 1 in the preceding embodiments, are omitted. In other words on the inner face of the rear plate 6, the coupling slots 17 are formed respectively between the lineal slots 16 which are arranged on that inner face so as to accommodate the keep alive cathodes 15 respectively and on both sides of which the elongated recesses 7 are arranged so as to generate the keep alive discharges commonly in the gas-discharge cells consisting respectively of those recesses 7. In this embodiment, the inner face of the front plate 1 is left as it is flat, having deposited thereon on the inner face, the lineal anode conductors 3, so that the gas-discharge spaces consisting in the cells are formed only of the elongated recesses 7 which are arranged on the inner face of the rear plate 6.

The embodiment shown in FIGS. 8(*a*) to (*c*) is the same as that shown in FIGS. 6(*a*) to (*c*) with regard to configuration, operation and function, except for the difference mentioned-above.

Figure 9:
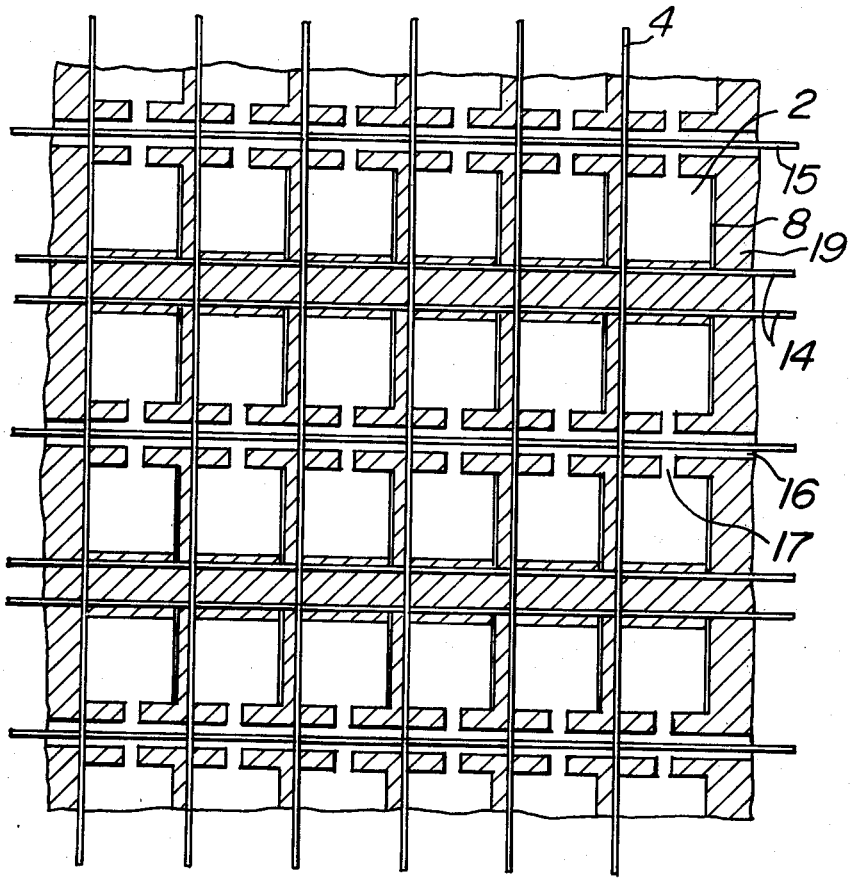
FIG. 9 is a partially enlarged plan view of still another preferred embodiment of a gas-discharge display panel according to the present invention.
Figure 10A:
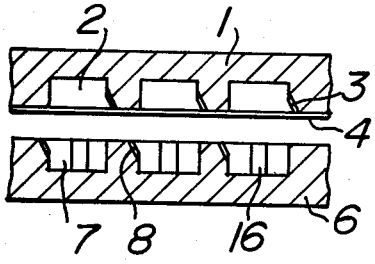
FIGS. 10(*a*) to 10(*e*) are cross-sectional views of various modifications of gas-discharge cells consisting in above-shown embodiments of a gas-discharge display panel according to the present invention.
Figure 10B:
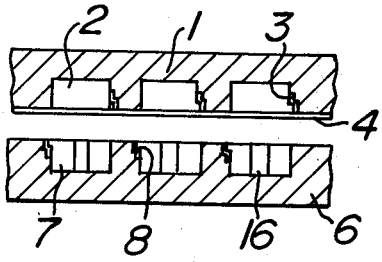
Figure 10C:
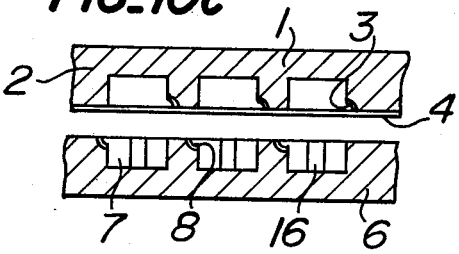
Figure 10D:
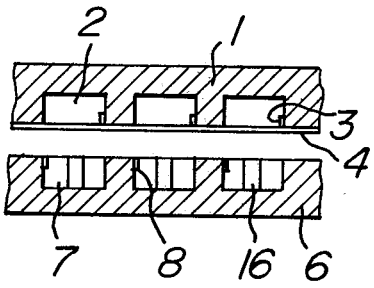
Figure 10E:
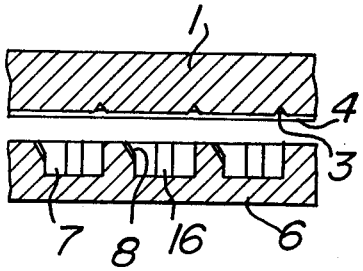

FIG. 9 is a partially enlarged plan view showing only the arrangement of the gas-discharge cells of still another embodiment of the gas-discharge panel according to the present invention. In the embodiment shown in FIG. 9, the gas-discharge spaces of the cells are arranged with a high density by virtue of forming those spaces in a square shape. Namely, plural square shaped recesses which are provided for forming those spaces are arranged on the inner faces of the front plate 1 and/or the rear plate 6.

The embodiment shown in FIG. 9 is the same as that shown in FIGS. 6(*a*) to (*c*) with respect to configuration, operation and function except for the difference mentioned-above.

Although the gas-discharge cells are formed in the rectangular and square shapes respectively in the embodiments shown in FIGS. 8(*a*) to (*c*) and 9, it should be appreciated that the gas-discharge spaces of the cells in the gas-discharge display panel according to the present invention can be formed in any desired shape, for example, in an ellipse or in a circle, as long as the elongated anode and cathode conductors are arranged in parallel respectively on the opposite edges of those gas-discharge spaces.

FIGS. 10(*a*), (*b*), (*cL* ), (*d*) and (*e*) show respectively the enlarged cross-sections of the various modifications of the portions of the gas-discharge cells usable in the gas-discharge display panel according to the present invention, in which portions the anodes and the cathodes are arranged.

In the embodiment shown in FIG. 10(*a*), obliquely cut faces are formed respectively on both of the openings of the recesses 2 and 7 which form the gas-discharge cells which cells are arranged respectively on the inner faces of the front plate 1 and the rear plate 6, and further the anode 3 and the cathode 8 consisting of elongated conductor thick films are deposited on those cut faces, for example, by means of electrolytic or non-electrolytic plating.

In the embodiments shown in FIGS. 10(*b*) and (*c*), the aforesaid cut faces are arranged on the opposite edges of the openings of the recesses which form the gas-discharge cells in a stair-step shape and in a curved shape respectively, and further the anodes 3 and the cathode 8 which consist of elongated thick conductor films are disposed on those cut faces.

In the embodiment shown in FIG. 10(*d*), the cut faces formed on the edges of the openings of the recesses forming the gas-discharge cells shown in the preceding embodiments are omitted, and further the anodes 3 and the cathodes 8 which consist of elongated thick conductor films are deposited on the side edges of the recesses 2 and 7.

In the embodiment shown in FIG. 10(*e*), the recesses 2 arranged on the inner face of the front plate 1 as shown in the preceding embodiments are omitted, and further the anodes 3, which consist of elongated thick conductor films, are deposited directly on the inner face of the front plate 1, while the cathodes 8, which consist of elongated thick conductor films, are deposited on obliquely cut faces formed on the edges of the openings of the recesses 7 which are arranged on the inner face of the rear plate 6.

In the gas-discharge display panel according to the present invention, the configuration and the operation of which were explained in detail as described above, the recesses which are provided for forming the gas-discharge spaces can be formed easily on a glass plate and alike by means of photo-etching, chemical etching or other processes, and the elongated anode and cathode conductors which are deposited on the side edges of those recesses can be formed comparatively easily by means of electrolytic or non-electrolytic plating as mentioned earlier, so that practical manufacturing of the display panel according to the present invention is easily obtained.

Obviously as explained above, the most realizable method of displaying a colored picture on the gas-discharge display panel, as described above, is that of exciting fluorescent layers which are deposited inside of the panel with the use of ultraviolet rays which are generated by the gas-discharge. However, the brightness of the colored picture which was displayed according to the known method of the above-mentioned kind was insufficient hitherto, so that the improvement of the insufficient brightness of the colored picture which is displayed on the gas-discharge display panel has been regarded as an important problem to be solved.

The principal items of the aforesaid problem can be listed as follows.

(1) In the conventional gas-discharge cells, the state of gas-discharge which contributes to the radiation of ultraviolet rays is not appropriate, causing the intensity of the radiated ultraviolet rays to be so low as to make it impossible to realize a high brightness of the color picture which is displayed on the conventional gas-discharge display panel.

(2) In the conventional gas-discharge cells, the positions whereon the fluorescent layers are disposed are inadequate, so that the light which is radiated from those fluorescent layers cannot be utilized sufficiently.

(3) In the conventional gas-discharge cells, the ultraviolet rays which are radiated from the plasma which is formed by the gas-discharge are attenuated by the absorption of the gas which is filled in the gas-discharge spaces before those rays arrive at the fluorescent layers which are disposed inside of those cells.

(4) In the conventional gas-discharge cells, it is impossible to endow those cells with the memory function, so that the high brightness of the colored picture which is displayed on the conventional gas-discharge display panel cannot be realized.

(5) The structure of the conventional gas-discharge cells is so complicated as it is difficult to manufacture those cells in practice, so that it is more difficult to realize a large area display panel.

According to the present invention, the above-described gas-discharge display panel which has a newly contrived structure is realized in order to solve the aforesaid various items of the problem concerning the conventional display panel. That is, in order to solve the item (1) in accordance with the present invention, the gas-discharge cell comprises an elongated cathode and anode which are arranged close by each other in parallel, and the fluorescent layers which are disposed inside of the cell are excited and brightened by the ultraviolet rays which are radiated from both of the negative glow in front of the cathode and the anode glow in front of the anode, which glows are generated by means of driving the cell with the pulsive voltages, so that an extremely bright color picture can be displayed.

Figure 11:
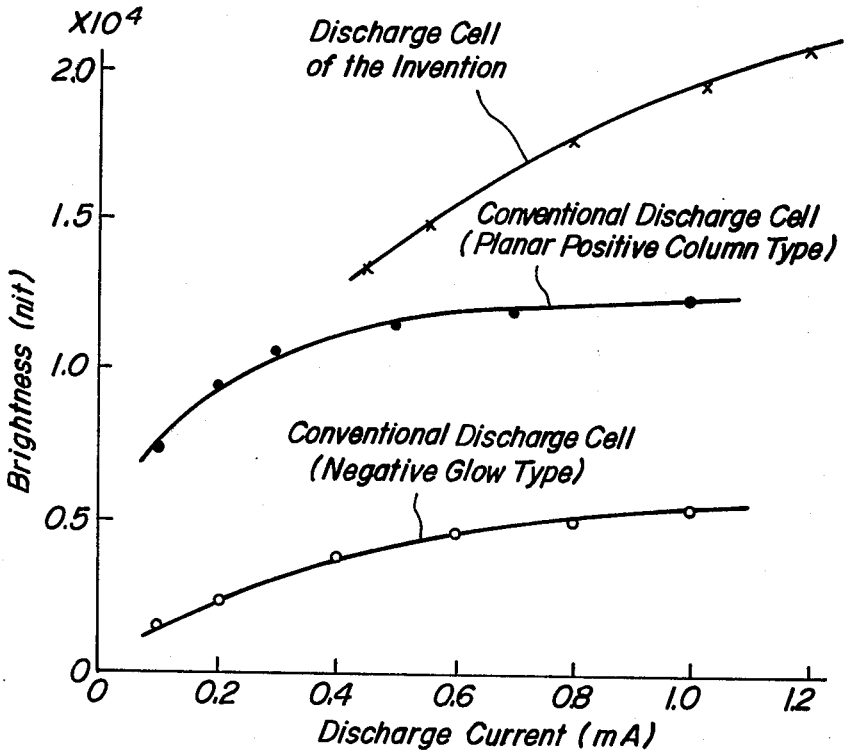
FIG. 11 is a graph showing operation characteristics of conventional gas-discharge cells and those of the present invention in comparison with each other.

FIG. 11 shows the brightness to discharge current characteristic curve of the gas-discharge cell according to the present invention in comparison with those of the conventional gas-discharge cells of negative glow type and planar positive column type.

In the aforesaid conventional gas-discharge cell of negative glow type, the ultraviolet rays which are radiated only from the negative glow in front of the cathode which is driven by the DC voltage is utilized alone to brighten the fluorescent layers. In this conventional cell, the density of the plasma is comparatively low, and the amount of radiated ultraviolet rays is small owing to the large cathode fall, and further the excitation and the ionization of the filled gas are effected vigorously on a higher energy level than that wherein the ultraviolet rays are radiated, so that the amount of radiated ultraviolet rays are reduced into a further lower amount.

On the other hand, in the aforesaid gas-discharge cell of planar positive column type, since the density of the plasma is higher than that in the cell of negative glow type, the amount of radiated ultraviolet rays is also larger than that of the cell of negative glow type. However, the electric field intensity of the plasma which consists in the positive column is not so strong, that the amount of atoms which are excited into the energy level wherein ultraviolet rays are radiated is comparatively small, so that it is difficult to realize a further larger amount of radiated ultraviolet rays.

The present inventors have investigated the utilization of the high electric field intensity of the plasma which consists in the anode fall in front of the anode in order to remove the above-mentioned defects of the conventional gas-discharge cells, and, as a result of this investigation, have found the fact that an extremely stable anode glow can be generated by means of driving the gas-discharge cell with the pulsive voltage. The electric field intensity of the plasma which is formed by the large anode fall in conjunction with the aforesaid anode glow can be regarded as conformable to the excitation of the filled gas into the energy level wherein ultraviolet rays are radiated.

In accordance therewith, as shown in FIG. 11, in the gas-discharge cell wherein the anode glow is utilized for the radiation of ultraviolet rays according to the present invention, an extremely high brightness can be realized in comparison with those of the above-mentioned conventional cells.

To solve the problems discussed in the aforesaid items (2) and (3), in the gas-discharge cell of the present invention, the fluorescent layers are disposed on the bottoms of the recesses which are arranged on the inner face of the rear plate, so as to enable the observation of brightening fluorescent layers in the manner of reflection, as well as the aforesaid utilization of both of the negative glow and the anode glow which are generated in front of the elongated cathode and anode respectively, which are arranged in parallel with each other close by the fluorescent layers, is effected, so that the display of the colored picture which has further higher brightness can be realized.

To solve the problems discussed in aforesaid item (4) according to the present invention, the memory function is endowed respectively to each one of gas-discharge cells by virtue of applying the sustaining pulsive voltages repeatedly, so that, in the gas-discharge cells according to the present invention, a much higher brightness can be obtained in comparison with that in the conventional cells. Moreover, in the gas-discharge cell of the present invention, since the anode and the cathode are disposed close by each other, it is possible to drive the cell with a low voltage source, so that the distinctive effect of improvement can be obtained in respect to the efficiency of driving power.

Finally to solve the problems discussed in aforesaid item (5) the present invention employs a simplified binary or two-component structure in the gas-discharge display panel, and the structure of individual gas-discharge cells themselves is evidently simplified, so that the manufacturing and the assembling of parts which compose the panel are facilitated remarkably, and further a display panel which has an extremely high density of distribution of the gas-discharge cells or which has an extremely large size can be provided easily, so that the practical usefulness of the panel a picture display panel can be increased.

What is claimed is:

1. In a gas-discharge display panel, wherein a plurality of gas-discharge cells are arranged in a matrix, the improvement comprising:

a transparent front insulator plate;

a rear insulator plate attached to said front insulator plate;

a plurality of minute elongated recesses provided at least on one of the inner faces of said front and rear insulator plates for forming a matrix of said gas-discharge cells located between said front and rear insulator plates;

an ionizable gas provided in said gas-discharge cells;

a plurality of pairs of elongated anode conductors and elongated cathode conductors disposed respectively in parallel with each other on opposite side elongated edges of said elongated recesses and separated by a minute distance; and a train of narrow width pulsive voltages applied between each of said pairs of elongated anode conductors and elongated cathode conductors at predetermined time intervals, said narrow width pulsive voltages being of a pulse width sufficient to cause main gas-discharges in said discharge cells consisting of sustained anode glows and cathode glows which appear closely adjacent respective anode and negative conductors.

2. A gas-discharge display panel as claimed in claim 1 wherein the cells of said matrix are individually separated one from the other and each cell is fluidly interconnected to other cells by slots which are narrower than the width of the recesses forming said cells.

3. A gas-discharge panel as claimed in claim 2, wherein the cathode conductors of each row of said gas-discharge cells in said matrix are connected in common, and said display panel further comprises a plurality of auxiliary cathode linear conductors accommodated respectively in a plurality of slots, said slots being formed on the inner face of said rear insulator plate and opening into respective groups of said gas-discharge cells, said auxiliary cathode electrodes when energized generating auxiliary gas-discharges which facilitate conduction of the main gas-discharges in said gas-discharge cells.

4. A gas-discharge display panel as claimed in claim 3, wherein said gas-discharge cells are characterized by an igniting threshold voltage level $V_{IO}$ (T) when no main gas-discharge has occured in a cell in a preceding time interval T, an igniting threshold voltage level $V_{I1}$ (T) when a main gas-discharge has occurred in a cell in said preceding time interval T, an auxiliary igniting voltage threshold $V_{OI}$ when no gas-discharge occurs in cells associated with a said auxiliary cathode, an igniting threshold voltage $V_{I1}$ ($T_{FA}$) when a time period $T_{FA}$ expires after a gas-discharge is sustained by a sustaining pulse train disappears in a cell, an igniting threshold voltage $V_{I1}$ ($T_{WA}$) when a time period $T_{WA}$ expires after a gas-discharge which is sustained by said sustaining pulse train has disappeared in a cell, and wherein positive and negative sustaining pulsive voltages $V_{SA}$ and $V_{SK}$ are applied respectively to said anode conductors and said cathode conductors, positive and negative igniting pulsive voltages $V_{FA}$ and $V_{FK}$ are applied respectively to said anode conductors and said cathode conductors, and positive and negative writing pulsive voltages $V_{WA}$ and $V_{WK}$ are applied respectively to said anode conductors and said cathode conductors together with said sustaining pulsive voltages $V_{SA}$ and $V_{SK}$, said voltages having the following relationships:

$$V_{I1}(T) < V_{SA} - V_{SK} < V_{I0}(T),$$

$$V_{SA} < V_{I1}(T),$$

$$V_{0I} < V_{FA} - V_{FK},$$

$$V_{FA} < V_{I1}(T_{FA}), \text{ and}$$

$$V_{I1}(T_{WA}) < V_{WA} - V_{WK}.$$

5. A gas-discharge display panel as claimed in claim 1 wherein the main gas-discharge in said cells is sustained by pulsive voltages applied to the elongated anode and cathode conductors of said cells.

6. A gas-discharge display panel as claimed in claim 2, wherein said recesses are formed in a rectangular shape.

7. A gas-discharge display panel as claimed in claim 2, wherein said recesses are elongated along said elongated anode conductors and said elongated cathode conductors.

8. A gas-discharge display panel as claimed in claim 2, wherein said recesses are formed in a square shape.

9. A gas-discharge display panel as claimed in claim 2, wherein fluorescent material layers are deposited at least on bottoms of said recesses, and are excited by both of said anode glows and said negative glows so as to emit light of predetermined colors.

10. A gas-discharge display panel as claimed in claim 2, wherein said train of pulsive voltages consists at least of an igniting pulse, a sustaining pulse-train and an erasing pulse for said gas-discharges, said sustaining pulse-train providing said gas-discharge cells with a memory function.

11. A gas-discharge display panel as claimed in claim 10, wherein said gas-discharge cells are characterized by an igniting threshold voltage $V_I$, and wherein a sustaining voltage $V_S$, an erasing voltage $V_E$, and igniting pulsive voltages $V_{FA}$ and $V_{FK}$ are applied respectively to said anode conductors and said cathode conductors and erasing pulsive voltages $V_{EA}$ and $V_{EK}$ are applied respectively to said anode conductors and said cathode conductors, said voltages having the following relationships:

$$V_E<V_S<V_I,$$

$$V_S<V_{FA}<V_I,$$

$$V_I<V_{FA}+V_{FK}, \text{ and}$$

$$V_E<V_{EA}-V_{EK}.$$

12. A gas-discharge display panel as claimed in claim 3, wherein each of said auxiliary cathode linear conductors are energized to generate said auxiliary gas-discharges which facilitate commonly conduction of said main gas-discharges in every two rows of said gas-discharge cells of said matrix.

13. A gas-discharge display panel as claimed in claim 3, wherein said anode conductors have successively applied thereto igniting positive pulse voltages and respective sustaining positive pulse voltages which ignite and sustain said gas-discharges respectively; said cathode conductors have successively applied thereto respective negative pulse voltages which respectively ignite and sustain said gas-discharges; and said auxiliary cathode linear conductors have applied thereto auxiliary igniting negative pulse voltages.

* * * * *